US005638682A

United States Patent [19]

Joshi et al.

[11] Patent Number: 5,638,682

[45] Date of Patent: Jun. 17, 1997

[54] AIR FUEL MIXER FOR GAS TURBINE COMBUSTOR HAVING SLOTS AT DOWNSTREAM END OF MIXING DUCT

[75] Inventors: Narendra D. Joshi, Cincinnati; Michael J. Epstein, West Chester, both of Ohio

[73] Assignee: General Electric Company, Cincinnati, Ohio

[21] Appl. No.: 311,639

[22] Filed: Sep. 23, 1994

[51] Int. Cl.[6] ..... F23R 3/32

[52] U.S. Cl. ..... 60/737; 60/748; 60/739

[58] Field of Search ..... 60/737, 748, 742, 60/738, 739; 431/9, 182, 183; 239/400, 406

[56] References Cited

U.S. PATENT DOCUMENTS

| | | | |
|---|---|---|---|
| 3,879,939 | 4/1975 | Markowski | 60/737 |
| 4,028,044 | 6/1977 | Carlisle | 60/748 |
| 4,082,495 | 4/1978 | Lefebvre | 239/406 |
| 4,488,869 | 12/1984 | Voorheis | 239/406 |
| 5,165,241 | 11/1992 | Joshi et al. | 60/737 |
| 5,251,447 | 10/1993 | Joshi et al. | 60/737 |
| 5,423,608 | 6/1995 | Chou et al. | 366/337 |

FOREIGN PATENT DOCUMENTS

| | | | |
|---|---|---|---|
| 1079949 | 3/1984 | U.S.S.R. | 431/9 |

*Primary Examiner*—Timothy S. Thorpe

*Attorney, Agent, or Firm*—Andrew C. Hess; Wayne O. Traynham

[57] ABSTRACT

An air fuel mixer is disclosed having a mixing duct, a set of inner and outer counter-rotating swirlers adjacent the upstream end of the mixing duct, and a hub separating the inner and outer swirlers to allow independent rotation thereof, wherein high pressure air from a compressor is injected into the mixing duct through the swirlers to form an intense shear region and fuel is injected into the mixing duct so that the high pressure air and the fuel is uniformly mixed therein so as to produce minimal formation of pollutants when the fuel/air mixture is exhausted out the downstream end of the mixing duct into the combustor and ignited. In addition, the mixing duct of the mixer includes slots, preferably with flares associated therewith, at its downstream end which modify the shape and direction of mixing eddies emanating therefrom.

10 Claims, 6 Drawing Sheets

AIR FUEL MIXER FOR GAS TURBINE COMBUSTOR HAVING SLOTS AT DOWNSTREAM END OF MIXING DUCT

BACKGROUND OF THE INVENTION

1. Field of the Invention

The present invention relates to an air fuel mixer for the combustor of a gas turbine engine, and, more particularly, to an air fuel mixer for the combustor of a gas turbine engine which includes slots at a downstream end of the mixing duct in order to improve mixing eddies emanating from the mixing duct and thereby reduce dynamic pressures in the combustor.

2. Description of Related Art

The present invention involves an improvement to air fuel mixers, and specifically to air fuel mixers previously filed by the assignee of the present invention. These air fuel mixers include U.S. Pat. No. 5,165,241, entitled "Air Fuel Mixer For Gas Turbine Combustor", U.S. Pat. No. 5,251,447, entitled "Air Fuel Mixer For Gas Turbine Combustor", and Ser. No. 08/170,969, entitled "Dual Fuel Mixer For Dry Low NOx Gas Turbine Combustor". As seen therein, each of these air fuel mixers includes a mixing duct, a set of inner and outer counter-rotating swirlers adjacent the upstream end of the mixing duct, and a hub separating the inner and outer swirlers to allow independent rotation thereof. Various manners of injecting fuel into the mixing duct are described in each patent/patent application. Accordingly, high pressure air from a compressor is injected into the mixing duct from the swirlers to form an intense shear region and fuel is injected into the mixing duct so that the high pressure air and the fuel is uniformly mixed therein so as to produce minimal formation of pollutants when the fuel/air mixture is exhausted out the downstream end of the mixing duct into the combustor and ignited.

While the aforementioned air fuel mixers have greatly increased mixing of fuel and air, and correspondingly reduced emissions produced from the burning thereof, it has been found that turbulent eddies are shed from the exit plane (or downstream end) of the mixing duct. In particular, it has been found, as depicted in FIG. 1, that such turbulent eddies are toroidal in shape (when viewed in cross-section) and have centerlines circular in nature which are convected downstream. The eddies are formed as the high velocity premixed fuel/air flow draws in and mixes with the recirculating hot burnt gases. The main problem with such toroidal eddies is that they have characteristic shedding frequencies which can couple with the fuel or air supply systems to set up a resonance. Accordingly, a need has arisen to modify the character of the eddies emanating from the exit of the mixing duct while preserving the ultra low $NO_x$ emission characteristic of the mixer.

SUMMARY OF THE INVENTION

In accordance with one aspect of the present invention, an air fuel mixer is disclosed having a mixing duct, a set of inner and outer counter-rotating swirlers adjacent the upstream end of the mixing duct, and a hub separating the inner and outer swirlers to allow independent rotation thereof, wherein high pressure air from a compressor is injected into the mixing duct through the swirlers to form an intense shear region and fuel is injected into the mixing duct so that the high pressure air and the fuel is uniformly mixed therein so as to produce minimal formation of pollutants when the fuel/air mixture is exhausted out the downstream end of the mixing duct into the combustor and ignited. In addition, the mixing duct includes slots, preferably with flares associated therewith, at its downstream end which modify the shape and direction of mixing eddies emanating therefrom.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
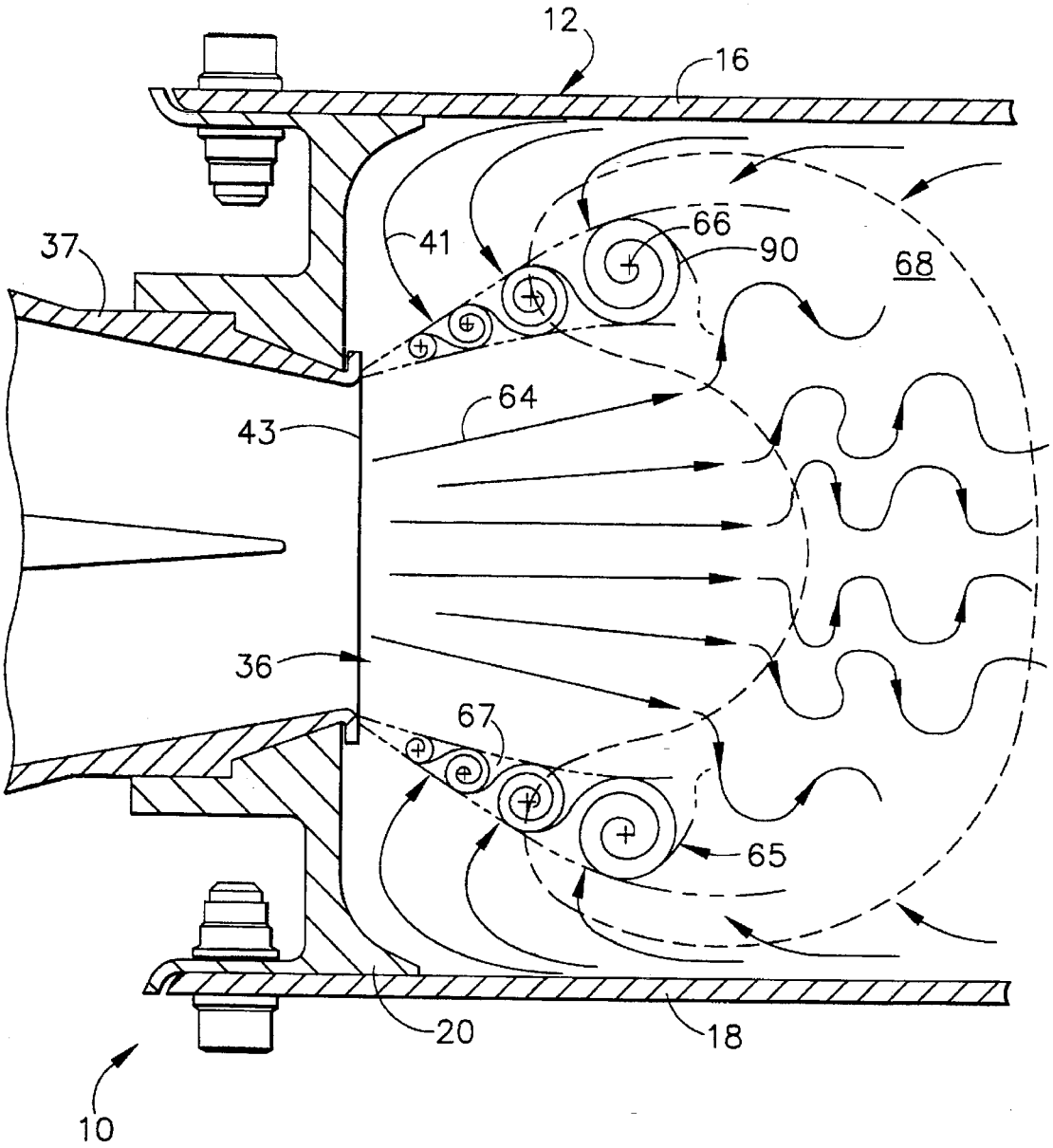
FIG. 1 (PRIOR ART)
FIG. 1 is a schematic depiction of the toroidal eddies emanating from the prior art mixer of U.S. Pat. No. 5,251,447.

Referring now to the drawings in detail, wherein identical numerals indicate the same elements throughout the figures, FIG. 1 depicts a partial cross-sectional view of a continuous burning combustion apparatus 10 disclosed in a patent application filed by the assignee of the present invention identified herein as U.S. Pat. No. 5,251,447, which is hereby incorporated by reference. While the modified mixing duct of the present invention can be utilized with any air fuel mixer having a mixing duct, a set of inner and outer counter-rotating swirlers with a hub therebetween, and means for supplying fuel into the mixing duct, the inventive mixing duct is described in relation to U.S. Pat. No. 5,251,447, for convenience. The combustion apparatus is of the type suitable for use in a gas turbine engine and comprises a hollow body 12 which defines a combustion chamber 14 therein. Hollow body 12 is generally annular in form and is comprised of an outer liner 16, an inner liner 18, and a domed end or dome 20. The domed end 20 of hollow body 12 includes a swirl cup 22, having disposed therein a mixer 24 to allow the uniform mixing of fuel and air therein and the subsequent introduction of the fuel/air mixture into combustion chamber 14 with the minimal formation of pollutants caused by the ignition thereof. Swirl cup 22, which is partially, shown in FIG. 1, is made up of mixer 24 and certain swirling means described in detail in U.S. Pat. No. 5,251,447.

As seen in FIG. 1, premixed fuel/air flow 64 emanating from the downstream end 36 of mixing duct 37 (i.e., at exit plane 43) produces turbulent eddies 65 when it mixes with recirculating hot burnt gases 41 in a mixing region 67. Eddies 65, which are toroidal in shape (when viewed in cross-section) and have centerlines 66 circular in nature, are then convected downstream into a heat release zone 68. As stated above, toroidal eddies 65 have characteristic shedding frequencies which can couple with the fuel or air supply systems to combustor 10 to set up a resonance, thereby increasing dynamic pressures and acoustic noise generated by mixer 24.

Figure 2:
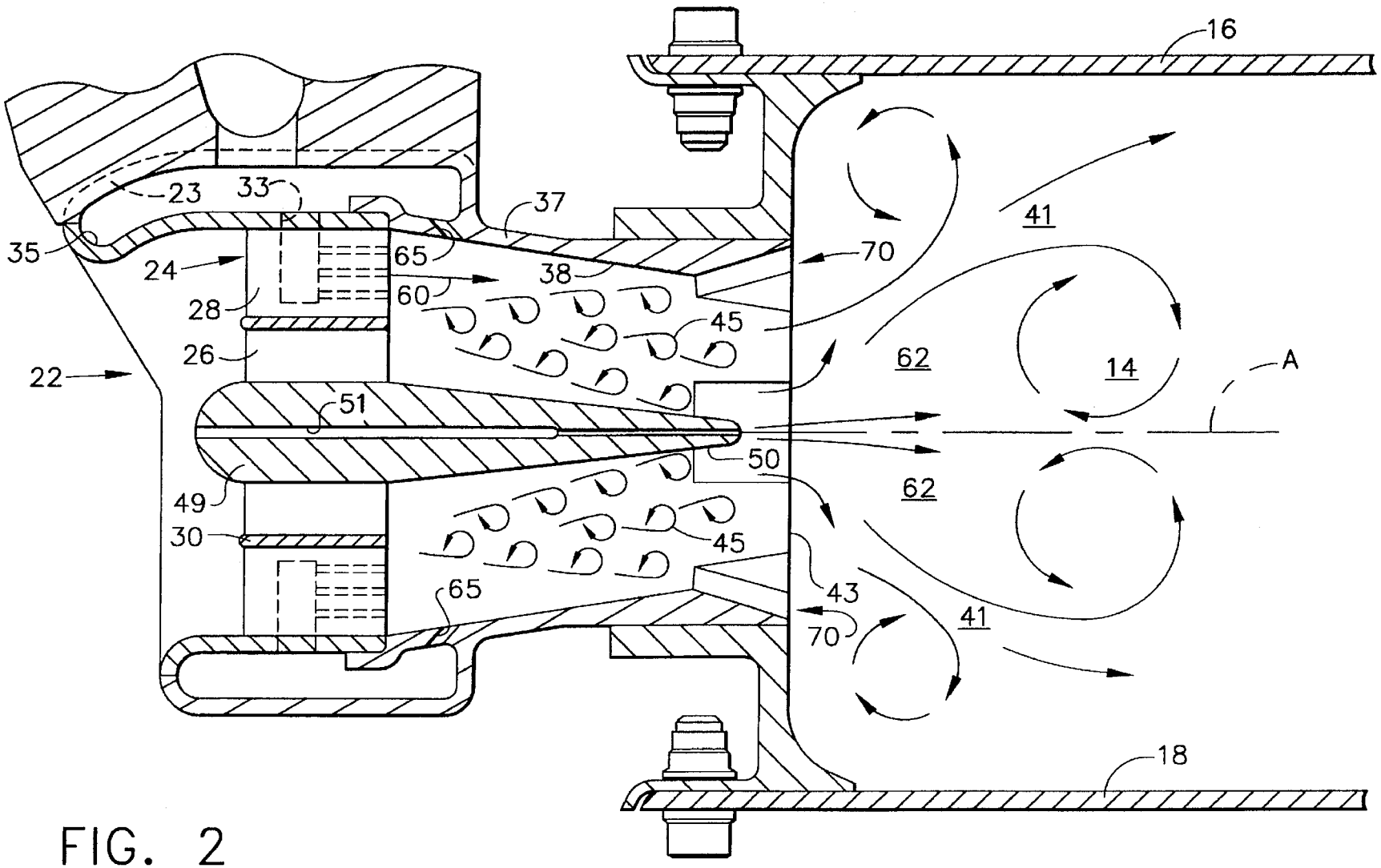
FIG. 2 is a cross-sectional view through a single annular combustor structure including an air fuel mixer having a modified mixing duct in accordance with the present invention.

FIG. 2 depicts a continuous burning apparatus like that shown in U.S. Pat. No. 5,251,447, with the downstream end 36 of mixing duct 37 modified in accordance with the present invention. Since all other elements are the same, only those that have been added for purposes of the present invention will have different identifying numerals.

As best seen in FIG. 2, mixer 24 includes inner swirler 26 and outer swirler 28 which are brazed or otherwise set in swirl cup 22, where inner and outer swirlers 26 and 28 preferably are counter-rotating. It is of no significance which direction inner swirler 26 and outer swirler 28 rotate so long as they do so in opposite directions. Inner and outer swirlers 26 and 28 are separated by a hub 30, which allows them to be co-annular and separately rotatable. As depicted in FIG. 2, inner and outer swirlers 26 and 28 are preferably axial, but they may be radial or some combination of axial and radial. It will be noted that swirlers 26 and 28 have vanes 32 and 34 (see FIG. 3 of U.S. Pat. No. 5,251,447) at an angle in the 40°–60° range with an axis A running through the center of mixer 24. Also, the air mass ratio between inner swirler 26 and outer swirler 28 is preferably approximately ⅓.

A shroud 23 is provided which surrounds mixer 24 at the upstream end thereof with a fuel manifold 35 contained therein. Downstream of inner and outer swirlers 26 and 28 is an annular mixing duct 37 which has been modified in accordance with the present invention. Fuel manifold 35 is in flow communication with vanes 34 of outer swirler 28 and is metered by an appropriate fuel supply and control mechanism (not shown). Although not depicted in the figures, fuel manifold 35 could be altered so as to be in flow communication with vanes 32 of inner swirler 26. Vanes 34 are of a hollow design, as shown and described in FIGS. 4*a* and 4*b* of U.S. Pat. No. 5,251,447.

A centerbody 49 is provided in mixer 24 which may be a straight cylindrical section or preferably one which converges substantially uniformly from its upstream end to its downstream end. Centerbody 49 is preferably cast within mixer 24 and is sized so as to terminate immediately prior to the downstream end 36 of mixing duct 37 in order to address a distress problem at centerbody tip 50, which occurs at high pressures due to flame stabilization at this location. Centerbody 49 preferably includes a passage 51 therethrough in order to admit air of a relatively high axial velocity into combustion chamber 14 adjacent centerbody tip 50. In order to assist in forming passage 51, it may not have a uniform diameter throughout. This design then decreases the local fuel/air ratio to help push the flame downstream of centerbody tip 50.

Inner and outer swirlers 26 and 28 are designed to pass a specified amount of air flow and fuel manifold 35 is sized to permit a specified amount of fuel flow so as to result in a lean premixture at exit plane 43 of mixer 24. By "lean" it is meant that the fuel/air mixture contains more air than is required to fully combust the fuel, or an equivalence ratio of less than one. It has been found that an equivalence ratio in the range of 0.4 to 0.7 is preferred.

As seen in FIG. 2, the air flow 60 exiting inner swirler 26 and outer swirler 28 sets up an intense shear layer 45 in mixing duct 37. The shear layer 45 is tailored to enhance the mixing process, whereby fuel flowing through vanes 34 is uniformly mixed with intense shear layer 45 from swirlers 26 and 28, as well as prevent backflow along the outer wall 48 of mixing duct 37. Mixing duct 37 may be a straight cylindrical section, but preferably should be uniformly converging from its upstream end to its downstream end so as to increase flow velocities and prevent backflow from primary combustion region 62. Additionally, the converging design of mixing duct 37 acts to accelerate the fuel/air mixture flow uniformly, which prevents boundary layers from accumulating along the sides thereof and flashback stemming therefrom. (Inner and outer swirlers 26 and 28 may also be of a like converging design).

Figure 3:
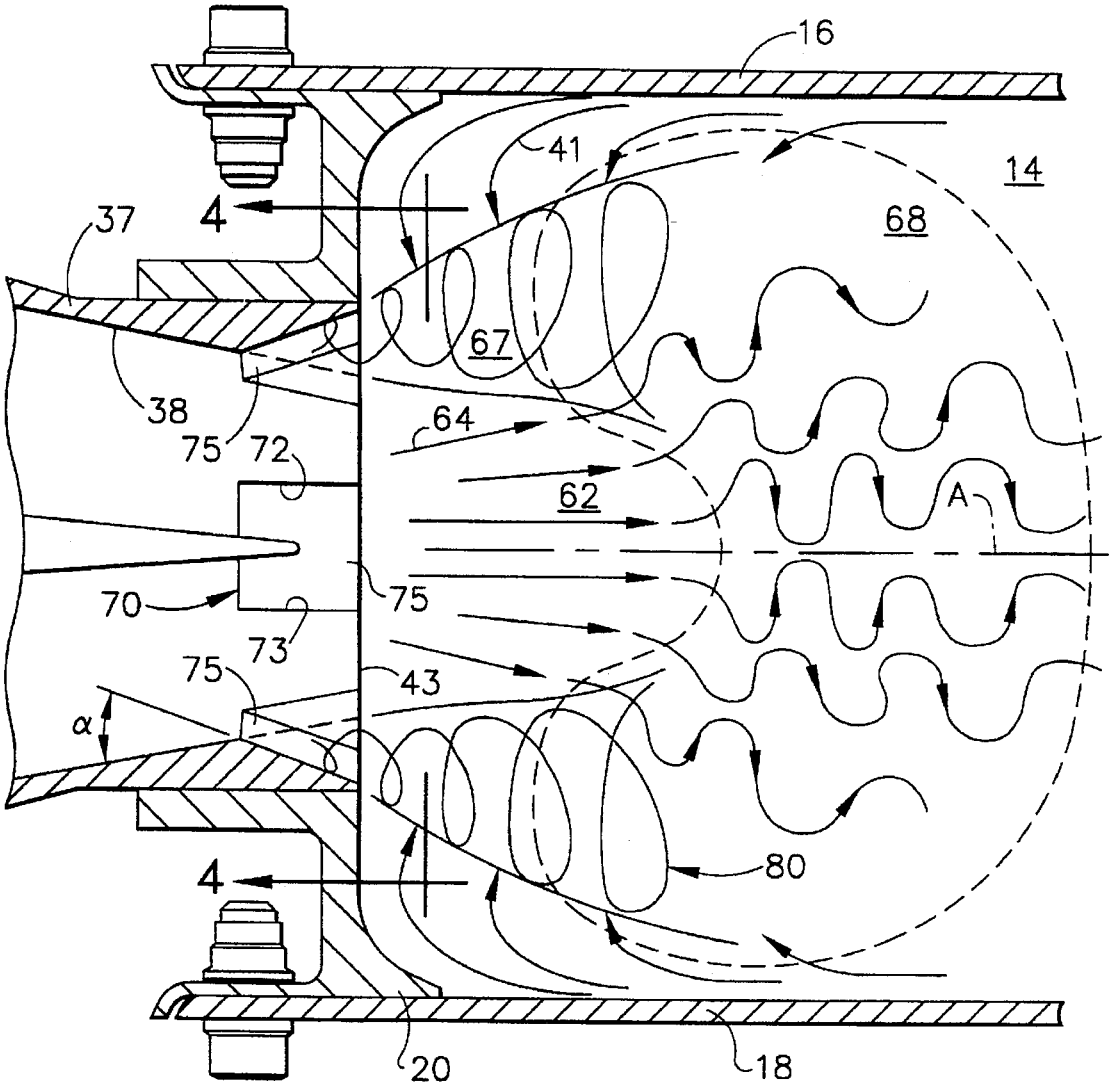
FIG. 3 is an enlarged partial cross-sectional view of the downstream end of the air fuel mixer and the upstream end of the combustor dome portion of FIG. 2, depicting the mixing eddies emanating from the mixer.
Figure 4:
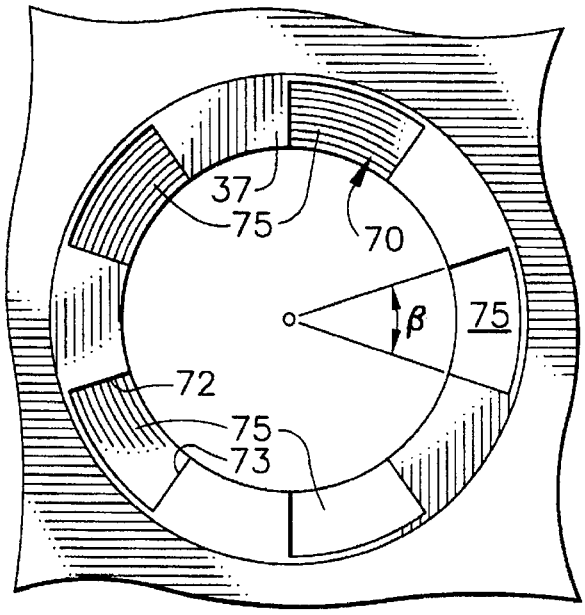
FIG. 4 is a partial aft view of the air fuel mixer depicted in FIGS. 2 and 3.
Figure 7:
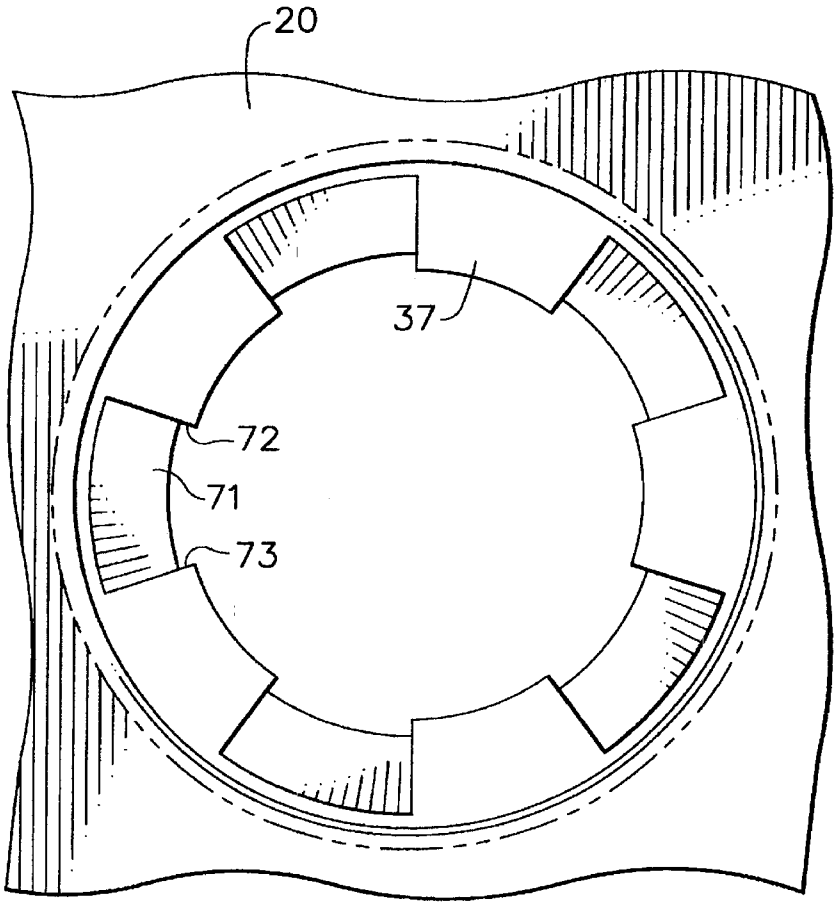
FIG. 7 is a partial aft view of the air fuel mixer depicted in FIG. 6.
Figure 6:
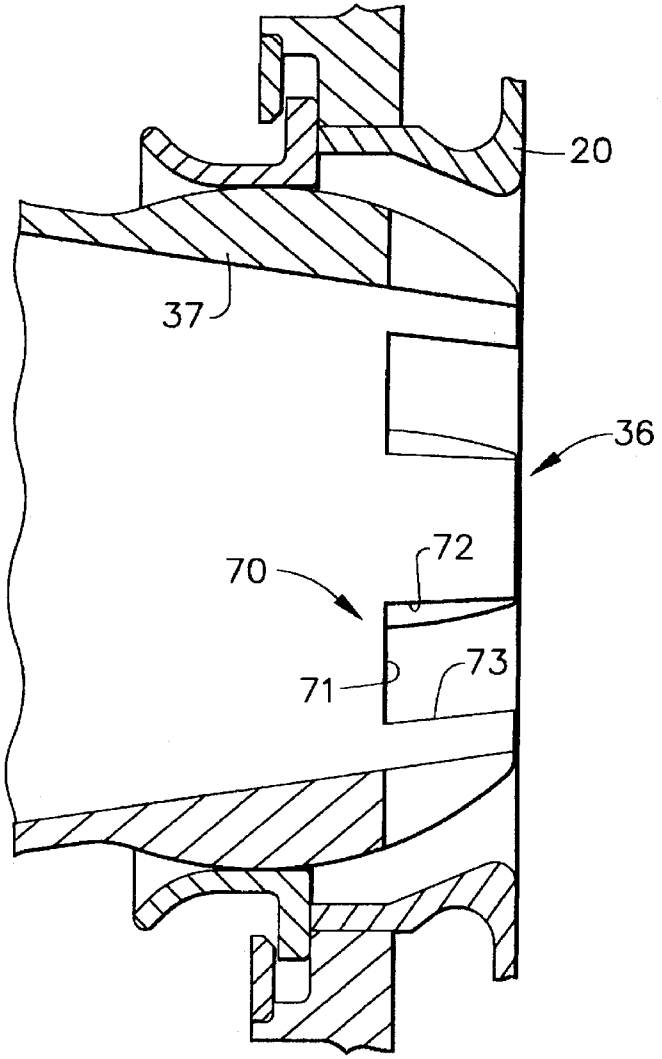
FIG. 6 is a partial cross-sectional view of an air fuel mixer having an alternate embodiment for the mixing duct of the present invention.

In accordance with the present invention, FIGS. 6 and 7 depict mixing duct 37 which has been modified to include a plurality of slots 70 at downstream end 36 thereof. As best seen therein, each slot 70 includes an upstream wall 71 and a pair of radial side walls 72 and 73. Although downstream end 36 of mixing duct 37 may include only the plurality of slots 70, as seen in FIGS. 6 and 7, it is preferred that upstream wall 71 of each slot 70 be flared. As seen in FIG. 3, flares 75 are provided at an angle $\alpha$ to converging annular wall 38 of mixing duct 37. Angle $\alpha$ may fall within a range of 0°–90°, but a more preferred range is 30°–60°. As shown in FIG. 3, angle $\alpha$ is approximately 45'° Also, while five separate slots 70 with flares 75 are shown in FIG. 4, any number of such slots with flares may be utilized depending on the desired annular distance for each slot. As seen in FIG. 4, each slot 70 has an approximate arc length $\beta$ of approximately 36°.

Figure 5:
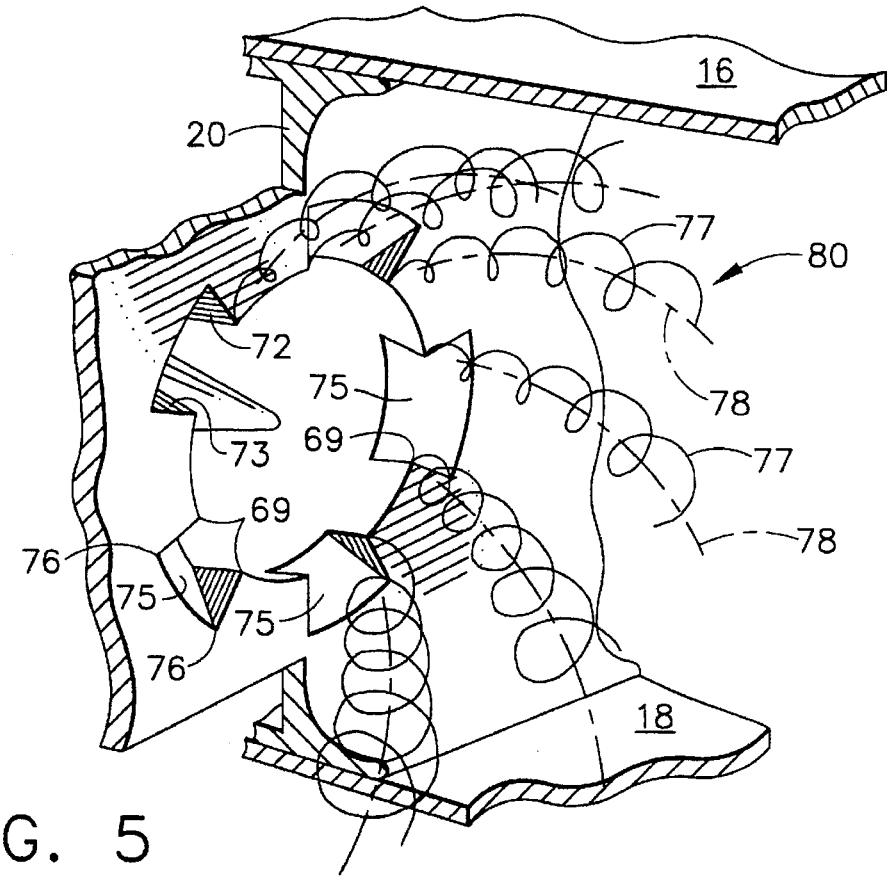
FIG. 5 is a partial perspective view of the downstream end of the air fuel mixer and upstream end of the combustor dome of FIG. 3, depicting the mixing eddies emanating from the mixer.

As best seen in FIGS. 3 and 5, flares 75 serve to allow the premixed fuel/air flow 64 to start preturning radially outward with respect to axis A in small segments, which enables a portion of the fuel/air flow 64 to expand into combustion chamber 14 sooner. Flares 75 also cause a secondary vortical flow 77, as shown in FIG. 5, which has a centerline 78 anchored to each downstream corner 76 of flares 75, as well as each downstream corner 69 of each slot 70. As a result of this modified flow field (where mixing eddies 80 roll off flares 75 in a manner similar to eddies rolling off aircraft wingtips), the mixing region 67 between the incoming fuel/air mixture 64 and the recirculating hot gases 41 in primary combustion region 62 is significantly energized, which, in turn, increases the damping of the dynamic pressures and acoustic noise generated by mixing eddies 90 of mixer 24 (see FIG. 1).

Figure 8:
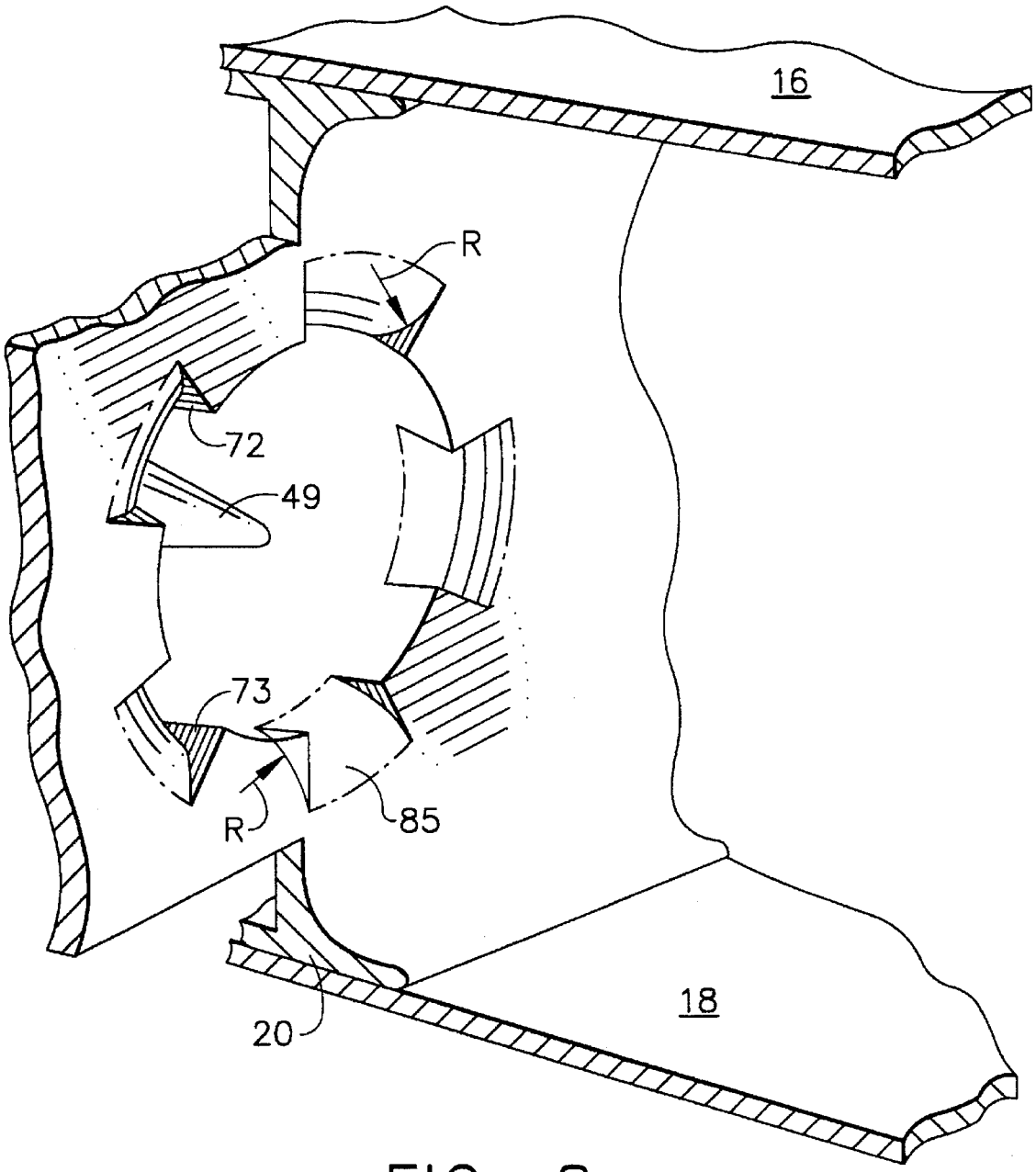
FIG. 8 is a partial perspective view of another embodiment of the modified mixing duct of the present invention having a radiused flare.

In addition to the flares 75 having a linear configuration as shown in FIG. 3, FIG. 8 depicts flares having an alternate design. In particular, FIG. 8 shows a flare 85 which is arcuate having a radius R. As with flares 75, flares 85 enable a portion of premixed fuel/air flow 64 to expand into combustion chamber 14 sooner and provide a secondary vortical flow. Thus, mixing region 67 is energized and dynamic pressures and acoustic noise are dampened. It will be noted that flares 85 are preferably configured so as not to extend downstream of exit plane 43.

In operation, compressed air from a compressor (not shown) is injected into the upstream end of mixer 24 where it passes through inner and outer swirlers 26 and 28 and enters mixing duct 37. Fuel is injected into air flow stream 60 (which includes intense shear layers 45) from passages 38 in vanes 34. (This may be varied depending on the manner of injecting fuel into mixing duct 37). At the downstream end 36 of mixing duct 37, the premixed fuel/air flow 64 is supplied into a mixing region 67 of combustion chamber 14 which is bounded by inner and outer liners 18 and 16. The premixed fuel/air flow 64 is then mixed with recirculating hot burnt gases 41 and burned in combustion chamber 14. Because the centerline of mixing eddies 80 are anchored to the downstream corners 69 of slots 70, as well as flares 75, or flares 85, a secondary vortical flow 77 is produced, the mixing region 67 is energized and dynamic pressure caused by the mixing eddy 90 is dampened by mixing eddy 80.

Having shown and described the preferred embodiment of the present invention, further adaptations of the mixer for providing uniform mixing of fuel and air can be accomplished by appropriate modifications by one of ordinary skilled in the art without departing from the scope of the invention.

What is claimed is:

1. An apparatus for premixing fuel and air prior to combustion in a gas turbine engine, comprising:

(a) a mixing duct having a circular cross-section defined by an annular wall, said mixing duct including an upstream end and a downstream end with a longitudinal axis extending therethrough, wherein said mixing duct downstream end has a plurality of spaced flared portions formed therein, each of said flared portions further comprising:

(1) an upstream wall flared radially outward from said annular wall; and (2) a pair of radial side walls located adjacent to each side of said upstream wall and connecting said upstream wall to said annular wall, wherein downstream corners are defined at the intersection of said upstream wall and said radial side walls adjacent said downstream end of said mixing duct;

(b) means for providing fuel to said mixing duct;

(c) a set of radially inner and outer annular counter-rotating swirlers adjacent said upstream end of said mixing duct for imparting swirl to an air stream; and (d) a hub separating said radially inner and outer annular swirlers to allow independent rotation thereof;

wherein high pressure air from a compressor is injected into said mixing duct through said swirlers to form an intense shear region and fuel is injected into said mixing duct so that the high pressure air and the fuel is uniformly mixed therein so as to produce minimal formation of pollutants when a fuel/air mixture is exhausted out the downstream end of the mixing duct into the combustor and ignited; and wherein said flared portions adjacent said downstream end of said mixing duct permit a portion of said fuel/air mixture to start preturning radially outward prior to said mixing duct downstream end and causes a secondary vortical flow of said fuel/air mixture which has a centerline anchored to each of said downstream corners formed by said upstream wall and said radial side walls.

2. The apparatus of claim 1, further comprising a centerbody located axially along said mixing duct and radially inward of said inner annular swirler.

3. The apparatus of claim 1, said fuel provision means further comprising:

(a) a shroud surrounding the upstream end of said mixing duct, said shroud having contained therein a fuel manifold in flow communication with a fuel supply and control means; and (b) said inner and outer annular swirlers including hollow vanes with internal cavities, wherein the internal cavities of at least said outer swirler vanes are in fluid communication with said fuel manifold, and said outer swirler vanes have a plurality of passages therethrough in flow communication with said internal cavities to inject fuel into said air stream.

4. The apparatus of claim 1, wherein swirl is also imparted to the fuel/air mixture so as to result in a pressure gradient in a primary combustion region of the combuster adjacent said mixing duct downstream end, whereby hot burnt gases are recirculated in said primary combustion region and mixed with said fuel/air mixture.

5. The apparatus of claim 1, wherein said mixing duct is substantially frusto-conical in shape from its upstream end having a first radius to its downstream end having a second radius less than said first radius.

6. The apparatus of claim 1, wherein said upstream walls of said flared portions are linear.

7. The apparatus of claim 6, wherein said upstream walls of said flared portions are at an angle in the range of 30°–60° to said annular wall.

8. The apparatus of claim 1, wherein said upstream walls of said flared portions are non-linear.

9. The apparatus of claim 8, wherein said upstream walls of said flared portions are arcuate.

10. The apparatus of claim 1, wherein said upstream walls of said flared portions are rectangular.

* * * * *